US008635954B2

(12) United States Patent
Takahashi et al.

(10) Patent No.: US 8,635,954 B2
(45) Date of Patent: Jan. 28, 2014

(54) INK TRAP METHOD AND AN INK TRAP APPARATUS

(75) Inventors: Nozomu Takahashi, Hiroshima (JP); Takekatsu Kobayshi, Kawanishi (JP); Tadayoshi Imai, Hiroshima (JP)

(73) Assignee: Toyo Seikan Kaisha, Ltd., Tokyo (JP)

( * ) Notice: Subject to any disclaimer, the term of this patent is extended or adjusted under 35 U.S.C. 154(b) by 386 days.

(21) Appl. No.: 12/449,736

(22) PCT Filed: Mar. 13, 2007

(86) PCT No.: PCT/JP2007/055585

§ 371 (c)(1),
(2), (4) Date: Aug. 24, 2009

(87) PCT Pub. No.: WO2008/111235

PCT Pub. Date: Sep. 18, 2008

(65) Prior Publication Data

US 2010/0005988 A1 Jan. 14, 2010

(51) Int. Cl.
*B41F 35/00* (2006.01)

(52) U.S. Cl.
USPC ..... 101/425; 101/423

(58) Field of Classification Search
USPC ..... 101/425
See application file for complete search history.

(56) References Cited

U.S. PATENT DOCUMENTS

| | | | | | |
|---|---|---|---|---|---|
| 3,763,778 | A * | 10/1973 | Sills et al. | 101/483 |
| 4,088,074 | A * | 5/1978 | Dahlgren et al. | 101/350.5 |
| 4,436,182 | A * | 3/1984 | Simonotti et al. | 186/37 |
| 4,475,456 | A * | 10/1984 | Ishii et al. | 101/144 |
| 4,757,763 | A | 7/1988 | Mac Phee | |
| 5,265,532 | A * | 11/1993 | DiDonato et al. | 101/40 |
| 5,390,602 | A * | 2/1995 | Gorl | 101/425 |
| 5,901,405 | A | 5/1999 | Tani | |
| 5,979,316 | A * | 11/1999 | Baum | 101/216 |
| 6,253,413 | B1 * | 7/2001 | Onuma et al. | 15/256.51 |
| 6,895,860 | B2 * | 5/2005 | Mori | 101/460 |
| 2005/0011384 | A1 * | 1/2005 | Sampei | 101/483 |

FOREIGN PATENT DOCUMENTS

| | | | |
|---|---|---|---|
| CN | 11471239 | A | 1/1997 |
| DE | 102005003083 | A1 | 7/2006 |
| EP | 0388757 | A1 | 9/1990 |
| JP | 58-072457 | A | 4/1983 |
| JP | 59-106967 | | 6/1984 |

(Continued)

OTHER PUBLICATIONS

PCT Internatinal Report on Patentability dated Oct. 8, 2005.

(Continued)

*Primary Examiner* — Anthony Nguyen
(74) *Attorney, Agent, or Firm* — Hedman & Costigan, P.C.; James V. Costigan; Kathleen A. Costigan

(57) ABSTRACT

A film F in the form of a belt which is provided in a manner to be fed out and wound up is wound on a trap roller 11 which is provided opposite to a blanket 4 of a blanket wheel 3 via a contacting and withdrawing mechanism 12. The film F is caused to contact the blanket 4 to remove surplus ink or blurring ink. By this arrangement, ink trap can be made by contacting an always clean film and ink trap can also be made with a simple mechanism for contacting and withdrawing the trap roller.

5 Claims, 7 Drawing Sheets

(56) References Cited

FOREIGN PATENT DOCUMENTS

| | | | |
|---|---|---|---|
| JP | 59-106967 | A | 6/1984 |
| JP | 02-008055 | | 1/1990 |
| JP | 04-041241 | | 2/1992 |
| JP | 06-022892 | A | 2/1994 |
| JP | 08-132598 | A | 5/1996 |
| JP | 9-123399 | | 5/1997 |
| JP | 09-123428 | | 5/1997 |
| JP | 11-099636 | A | 4/1999 |
| JP | 2001-138484 | | 5/2001 |
| JP | 2007-76229 | | 3/2007 |

OTHER PUBLICATIONS

PCT Search Report dated Apr. 24, 2007.
Chinese Patent Office Action dated Jul. 5, 2011.
Supplementary European Search Report May 14, 2012 with Examiner's Report (4 pages).
JP Office Action dated Oct. 11, 2011 with English Translation.

* cited by examiner

TRAP ROLLER
CONTACTING BLANKET

TRAP ROLLER TRIPPING
FROM BLANKET

A – A

INK TRAP METHOD AND AN INK TRAP APPARATUS

TECHNICAL FIELD

This invention relates to an ink trap method and an ink trap apparatus and, more particularly, to an ink trap method and an ink trap apparatus which can remove surplus ink or blurring ink in a simple manner during a period of time from starting or re-staring of the printer till entering a normal printing operation without necessity for operating a printer by using an object to be printed which becomes a product. The method and apparatus are particularly useful for application to a printer of a drink can or the like for preventing production of a printed can which is not suitable as a product.

BACKGROUND ART

When a printer for printing an object to be printed is started for printing or re-started after a color change or a version change is made, an amount of supply of ink tends to change and, as a result, surplus ink or blurring ink is adhered to the object to be printed and a normal product cannot be produced until a normal printing operation mode is brought about.

It has been practiced so far to supply a plurality of the same objects to be printed as a product during a period of time from starting or re-staring of the printer to starting of a normal printing operation and throw away these objects after printing.

In view of the fact that the objects to be printed which must be supplied and destroyed until starting of a normal printing operation amounts to a substantial number, Japanese Patent Application Laid-open Publication No. 9-123399 discloses a method for bringing about a normal printing operation without using an object to be printed which becomes a product.

According to this method, in an offset printer, an impression cylinder is separated from a blanket cylinder and an auxiliary roll is provided. This auxiliary roll is caused to contact the blanket cylinder and a part of ink which has been transferred to the blanket cylinder is transferred to the auxiliary roll. Then, this auxiliary roll is immersed in a solvent in a container, ink is wiped off with a wiping member and solvent adhering to the auxiliary roll is scraped off with a scraper. Then the auxiliary roll is caused to contact the blanket cylinder again. By repeating this operation several times before starting of printing, a normal printing state can be attained without using an object to be printed which becomes a product.

In this printing method, the operation in which ink transferred to the auxiliary roller is wiped off by immersing the auxiliary roller in a solvent and the solvent adhering to the auxiliary roller is scraped off is repeated is repeated for attaining a normal printing state but, as this operation is repeated, concentration of the ink in the solvent becomes gradually high and the wiping member is gradually soiled and, as a result, cleanliness of the auxiliary roll is deteriorated and it becomes difficult to attain a normal operation state under the same condition that a clean object to be printed which becomes a product is used.

Moreover, as printing speed increases, speed of rotation of the auxiliary roller also increases and there occurs the problem of scattering of the solvent and wiped off ink.

Furthermore, it is necessary to add a mechanism for vertically moving the impression cylinder of the printer itself and move the auxiliary roll with the container of the solvent and, as a result, the mechanism of the apparatus becomes complicated and bulky.

DISCLOSURE OF THE INVENTION

It is an object of the present invention to solve the problems of the prior art and provide an ink trap method and an ink trap apparatus which can remove surplus ink or blurring ink with a simple mechanism in the same manner as in a case where an object to be printed which becomes a product is used.

In the first aspect of the invention which solves the above described problems of the prior art, there is provided an ink trap method for removing surplus ink or blurring ink before starting of a normal printing operation by a blanket in a printing machine in which ink is transferred from an ink supply unit to a blanket of a blanket wheel and transfer printing is made from the blanket to an object to be printed, wherein a film which is fed while moving in a rotating motion opposite to the blanket of the blanket wheel is caused to contact the blanket and thereby remove surplus ink or blurring ink by transferring the surplus ink or blurring ink to the film.

In the scone aspect of the invention, there is provided an ink trap method as defined in the first aspect wherein the film which has contacted the blanket and removed the surplus ink or blurring ink by transferring is wound up.

In the third aspect of the invention, there is provided an ink trap method as defined in the first or second aspect wherein the film can contact the blanket and withdraw from it through a trap roller which can rotate opposite to the blanket of the blanket wheel and, after ink trap is started by moving the film to a position at which the film contacts the blanket, the film is withdrawn upon completion of the ink trap to start a normal printing operation.

In the fourth aspect of the invention, there is provided an ink trap apparatus for removing surplus ink or blurring ink before starting of a normal printing operation by a blanket in a printing machine in which ink is transferred from an ink supply unit to a blanket of a blanket wheel and transfer printing is made from the blanket to an object to be printed, said apparatus comprising a trap roller located opposite to the blanket of the blanket wheel and being capable of contacting the blanket and withdrawing from the blanket, and a film which can be fed and wound on the trap roller to remove the surplus ink or blurring ink.

In the fifth aspect of the aspect of the invention, there is provided an ink trap apparatus as defined in the fourth aspect wherein the film which has removed the surplus ink or blurring ink can be wound up.

In the sixth aspect of the invention, there is provided an ink trap apparatus as defined in the fourth or fifth aspect further comprising a drive roller which drives the film to be pulled out and is located on downstream side in feeding direction of the film from a position at which the trap roller contacts the blanket through the film.

In the seventh aspect of the invention, there is provided an ink trap apparatus as defined in the sixth aspect wherein the drive roller has spikes on the surface of the roller for increasing force to pull out the film.

In the eighth aspect of the invention, there is provided an ink trap apparatus as defined in any of the fourth to seventh aspects wherein the apparatus further comprises a feed shaft of the film and a wind-up shaft of the film wherein the trap roller and/or the drive roller are driven for rotation and the feed shaft and the wind-up shaft are driven for rotation respectively through a friction transmitting mechanism.

In the ninth aspect of the invention, there is provided an ink trap apparatus as defined in any of the fourth to eighth aspects further comprising position detection means for detecting each of intervals between a plurality of the blankets which are provided on the blanket wheel, and control means for controlling contacting and withdrawing of the trap roller in response to a position detection signal from the position detection means.

In the tenth aspect of the invention, there is provided an ink trap apparatus as defined in any of the fourth to ninth aspects further comprising assisting rollers provided adjacent to the trap roller and/or the drive roller for increasing a winding contact angle of the film wherein at least the assisting roller which contacts an ink transferred surface of the film after the ink trap is provided on the surface of the assisting roller with an ink adhesion preventing layer for preventing adhesion of the ink.

In the eleventh aspect of the invention, there is provided an ink trap apparatus as defined in any of the fourth to tenth aspects further comprising an applicator roller provided in the printer for coating a finishing coating on a printing surface of the object to be printed and removing means for removing surplus finishing coating before the normal printing operation by contacting the applicator roller.

According to the ink trap method of the first aspect of the invention, since a film which is fed while moving in a rotating motion opposite to the blanket of the blanket wheel is caused to contact the blanket and thereby remove surplus ink or blurring ink by transferring the surplus ink or blurring ink to the film, the ink trap can be performed with a simple mechanism by contacting an always clean film without using an object to be printed which becomes a product.

According to the ink trap method of the second aspect of the invention, since the film which has contacted the blanket and removed the surplus ink or blurring ink by transferring is wound up, an amount of film necessary for the ink trap can be continuously supplied whereby a normal printing state can be attained by a simple ink trap and, moreover, the film after the ink trap can be dealt with in a simple manner.

According to the ink trap method of the third aspect of the invention, since the film can contact the blanket and withdraw from it through a trap roller which can rotate opposite to the blanket of the blanket wheel and, after ink trap is started by moving the film to a position at which the film contacts the blanket, the film is withdrawn upon completion of the ink trap to start a normal printing operation, a normal printing state can be easily attained by performing the ink trap in a simple manner by moving the trap roller.

According to the fourth aspect of the invention, since there is provided an ink trap apparatus for removing surplus ink or blurring ink before starting of a normal printing operation by a blanket in a printing machine in which ink is transferred from an ink supply unit to a blanket of a blanket wheel and transfer printing is made from the blanket to an object to be printed, said apparatus comprising a trap roller located opposite to the blanket of the blanket wheel and being capable of contacting the blanket and withdrawing from the blanket, and a film which can be fed and wound on the trap roller to remove the surplus ink or blurring ink, the film wound on the trap roller can be fed to contact the blanket to remove surplus ink or blurring ink and, therefore, the ink trap can be performed by contacting an always clean film to the blanket and the ink trap can be performed with a simple mechanism which can contact the blanket and withdraw from it.

According to the ink trap apparatus of the fifth aspect of the invention, since the film which has removed the surplus ink or blurring ink can be wound up, an amount of film necessary for the ink trap can be continuously supplied whereby a normal printing state can be attained by a simple ink trap and, moreover, the film after the ink trap can be dealt with in a simple manner.

According to the ink trap apparatus of the sixth aspect of the invention, since a drive roller which drives the film to be pulled out and is located on downstream side in feeding direction of the film from a position at which the trap roller contacts the blanket through the film, the ink trap can be performed by using a stable film which is free from slipping or occurrence of a wrinkle.

According to the ink trap apparatus of the seventh aspect of the invention, since the drive roller has spikes on the surface of the roller for increasing force to pull out the film, while an amount of the fed out film for a single rotation of the drive roller is maintained at the length of circumference of the drive roller, slipping of the film on the drive roller can be prevented and occurrence of difference between the running speed of the film and the speed of the blanket can thereby be prevented. Moreover, since the force to pull out the film is increased, the ink trap can be performed with a belt-like film in a very stable state.

According to the ink trap apparatus of the eighth aspect of the invention, since a feed shaft of the film and a wind-up shaft of the film are provided and the trap roller and/or the drive roller are driven for rotation and the feed shaft and the wind-up shaft are driven for rotation respectively through a friction transmitting mechanism, in a case where drive for rotation is made by a single drive source, rotation can be performed at a speed which corresponds to an amount of wind-up and an amount of feed whereby the ink trap can be made with a film in a very stable state.

According to the ink trap apparatus of the ninth aspect of the invention, since the apparatus comprises position detection means for detecting each of intervals between a plurality of the blankets which are provided on the blanket wheel, and control means for controlling contacting and withdrawing of the trap roller in response to a position detection signal from the position detection means, the interval between the blankets of the blanket wheel is detected by the position detection means and contacting and withdrawing of the trap roller is controlled by the control means in response to a position detection signal of the position detection means and, therefore, the ink trap can be performed accurately for each of the blankets.

According to the ink trap apparatus of the tenth aspect of the invention, since the apparatus comprises assisting rollers provided adjacent to the trap roller and/or the drive roller for increasing a winding contact angle of the film wherein at least the assisting roller which contacts an ink transferred surface of the film after the ink trap is provided on the surface of the assisting roller with an ink adhesion preventing layer for preventing adhesion of the ink, the ink trap can be made while adhesion of the ink to the surface of the roller which contacts the ink can be prevented.

According to the ink trap apparatus of the eleventh aspect of the invention, since the apparatus comprises an applicator roller provided in the printer for coating a finishing coating on a printing surface of the object to be printed and removing means for removing surplus finishing coating before the normal printing operation by contacting the applicator roller, not only printing ink but also finishing coating can be trapped before a normal printing operation.

DESCRIPTION OF PREFERRED EMBODIMENTS OF THE INVENTION

An embodiment of the invention will now be described in detail with reference to the accompanying drawings.

Figure 1:
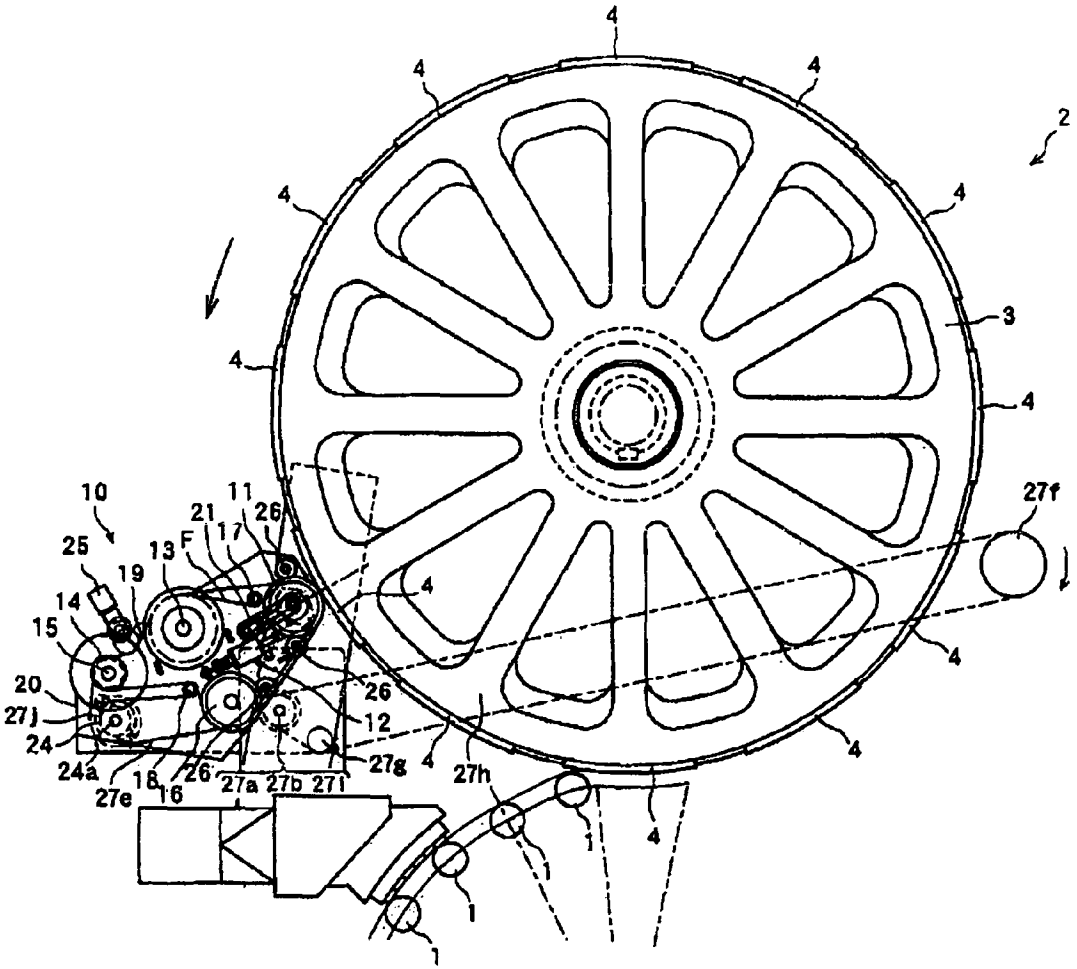
FIG. 1 is a schematic front view of an embodiment of an entire apparatus in which the ink trap apparatus of the present invention is applied to a printing machine for printing a body of a can.
Figure 2:
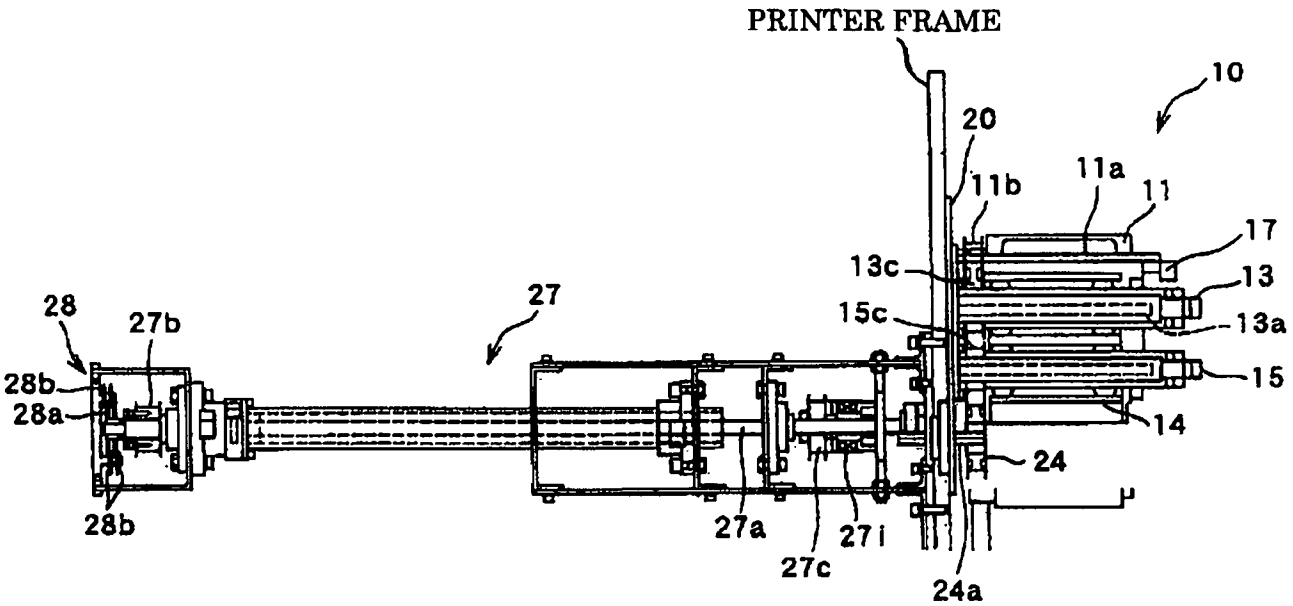
FIG. 2 is a schematic plan view of the embodiment of the entire apparatus in which the ink trap apparatus of the present invention is applied to the printing machine for printing a body of a can.
Figures 3, 3A:
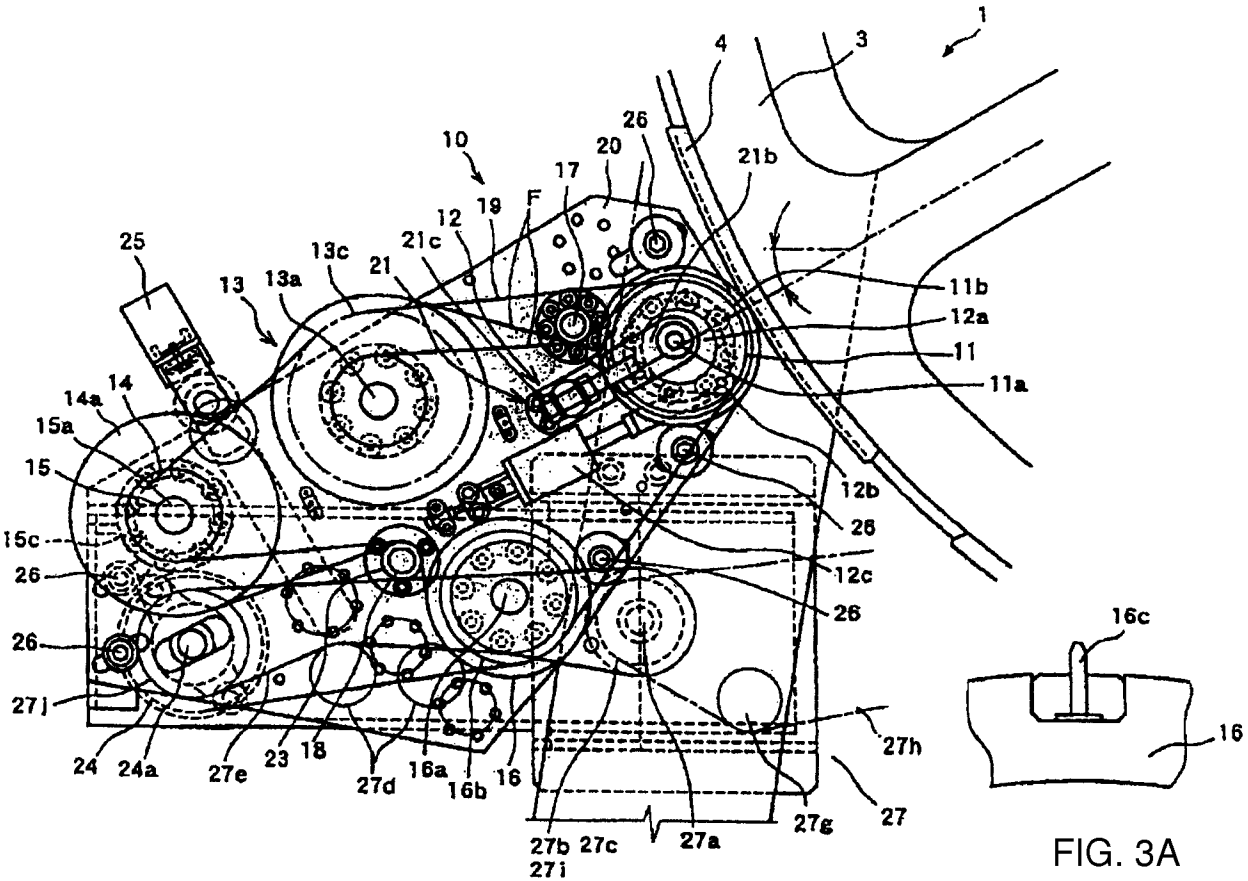
FIG. 3 is an enlarged front view of the embodiment of the ink trap apparatus of the invention which is applied to the printing machine for printing a body of a can.
FIG. 3A is an enlarged scale view of a section of drive roller 16.
Figure 4:
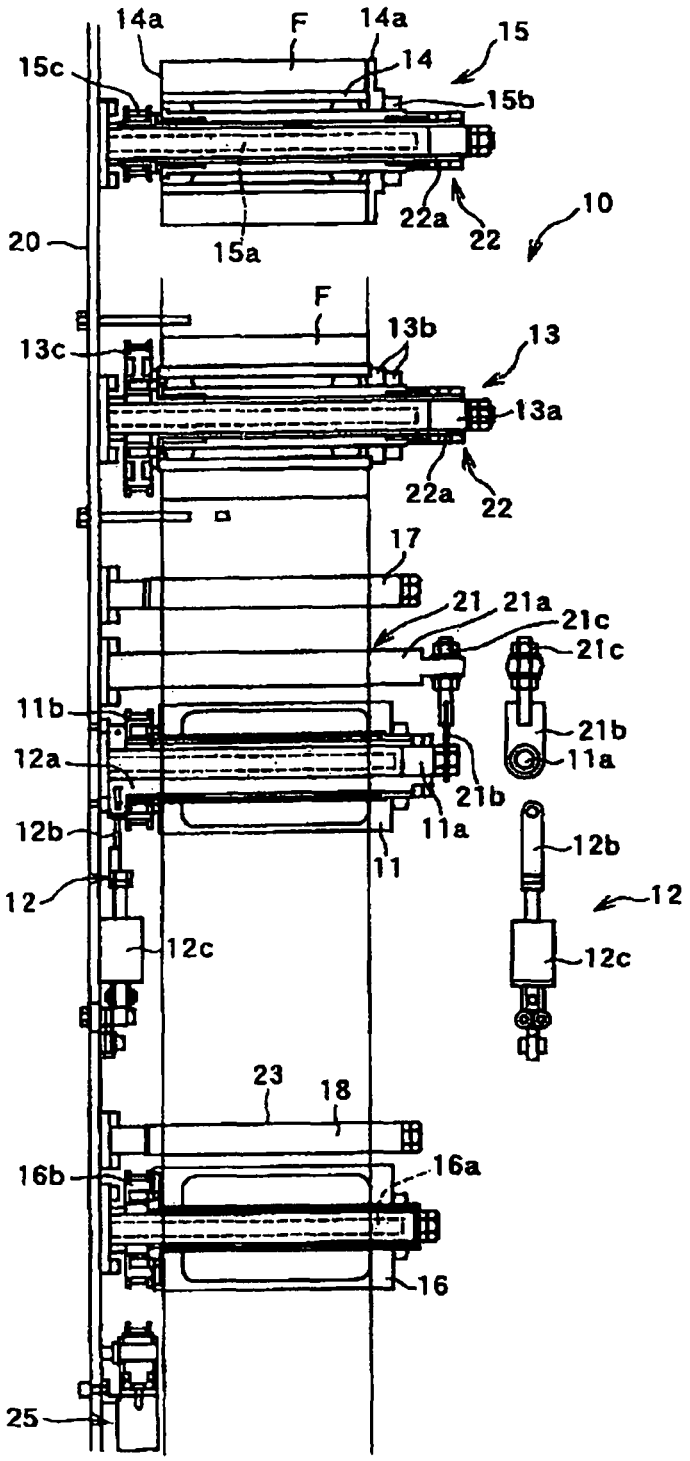
FIG. 4 is a sectional view showing developed view of respective rollers of the embodiment of the ink trap apparatus of the invention which is applied to the printing machine for printing a body of a can.
Figure 5A:
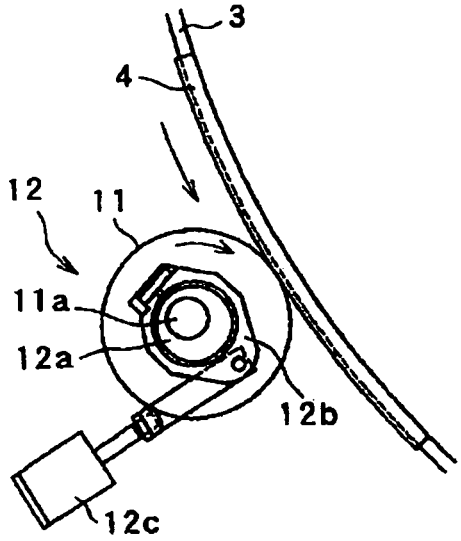
FIGS. 5A and 5B are views for explaining the contacting and withdrawing mechanism of the trap roller of the embodiment of the ink trap apparatus which is applied to the printing machine for printing a body of a can.
Figure 5B:
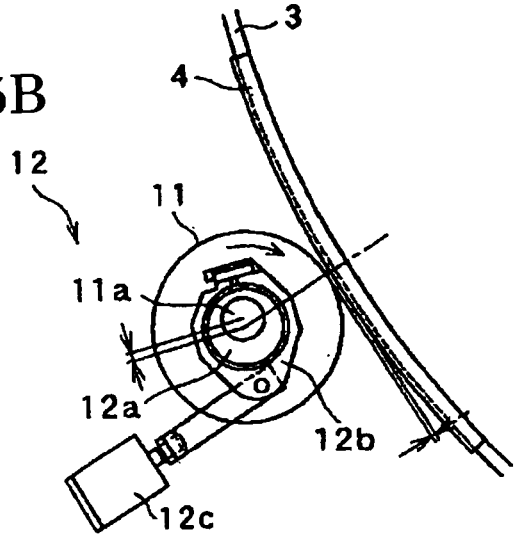
Figure 6A:
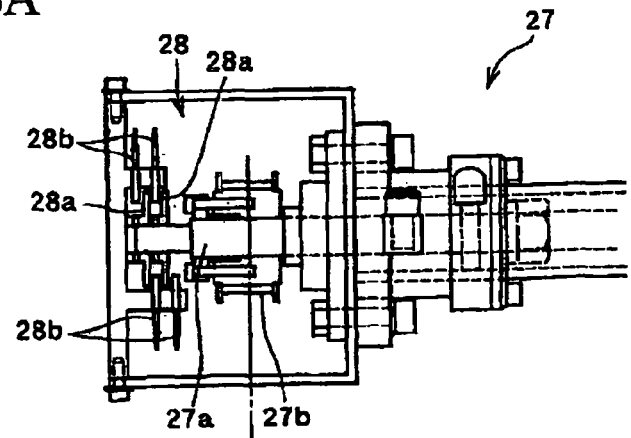
FIGS. 6A, 6B and 6C are views for explaining the blanket position detection means of the embodiment of the ink trap apparatus which is applied to the printing machine for printing a body of a can.
Figure 6C:
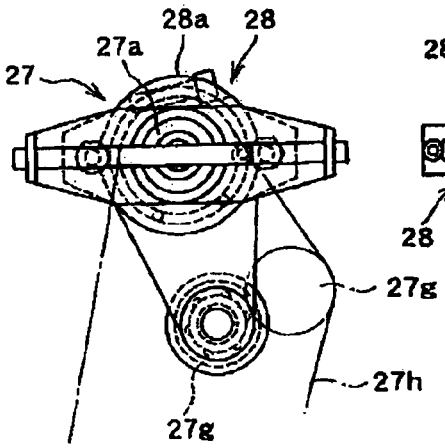
Figure 6B:
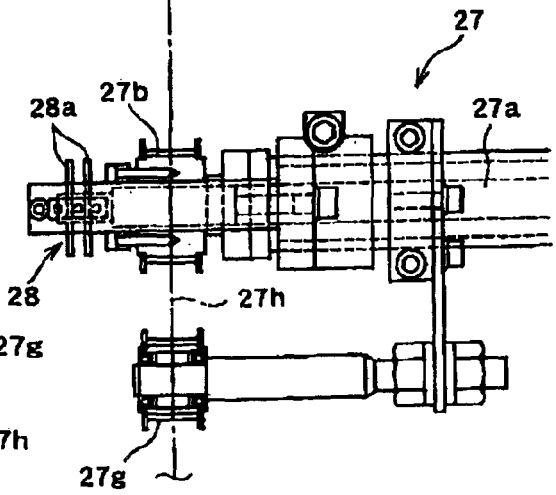

FIGS. 1 to 6 show an embodiment of the ink trap apparatus of the invention which is applied to a printing machine for printing a body of a can in which FIG. 1 is a schematic front view of the entire apparatus, FIG. 2 is a schematic plan view of the entire apparatus, FIG. 3 is an enlarged front view, FIG. 4 is a sectional view showing respective rollers in developed views, FIGS. 5A and 5B are explanatory views of the contacting and withdrawing mechanism of the trap roller and FIGS. 6A, 6B and 6C are explanatory views of the blanket position detection means.

This ink trap apparatus 10 is attached to a printer 2 for conducting transfer printing to a can body 1 and the ink trap apparatus 10 removes surplus ink or blurring ink before entering a normal printing operation.

In a normal printing operation, the printer 2 transfers ink from a plurality of unillustrated printing heads which constitute an ink supply unit to a plurality (e.g., 12) of blankets 4 of a blanket wheel 3, and performs transfer printing from each of the blankets 4 to each of can bodies 1 which is an object to be printed and is continuously supplied. When the printer 2 is started or it is re-started after change of color of printing or printing version, this ink trap apparatus 10 removes surplus ink or blurring ink before the normal printing operation by causing a film F in the form of a belt to contact each of the blankets 4 and transfer the ink to the film F.

In this ink trap apparatus 10, there is provided a trap roller 11 on which the film F is wound via a contacting and withdrawing mechanism 12 which causes the trap roller 11 to contact the blanket 4 and withdraw from it. On the upstream side of the trap roller 11, there is provided a feed shaft 13 for feeding out the film F which is wound about the feed shaft 13 in the form of a roll. On the downstream side of the trap roller 11, there is provided a wind-up shaft 15 having a wind-up core 14 on which the film F after the ink trap is wound up. A drive roller 16 is provided between the trap roller 11 and the wind-up shaft 15 for pulling out the film F. On the upstream side of the trap roller 11, an assisting roller 17 is provided adjacent to the trap roller 11 and on the downstream side of the drive roller 16, an assisting roller 18 is provided adjacent to the drive roller 16 so as to increase the winding contact angle of the film F. By increasing the winding contact angle of the film F by providing the assisting rollers 17 and 18 adjacent to both or either of the trap roller 11 and the drive roller 16, the ink trap can be performed with the film F which is in a very stable state.

In this ink trap apparatus 10, the two rollers 11 and 16 other than the two assisting rollers 17 and 18 and the two shafts 13 and 15 are driven and rotated with a toothed belt 19 as will be described later.

In this ink trap apparatus 10, the trap roller 11 is rotatably mounted on a support shaft 11*a* which is attached on one end thereof to a frame 20 via an eccentric shaft 12*a* which constitutes a part of the contacting and withdrawing mechanism 12. The toothed belt 19 is wound on a pulley 11*b* attached to the base end portion of the trap roller 11 to drive the trap roller 11 for rotation.

An operation arm 12*b* is attached to the eccentric shaft 12*a* of the contacting and withdrawing mechanism 12. By rotating the eccentric shaft 12*a* with an air cylinder 12*c* which is connected to one end portion of the operation arm 12*b* and functions as an actuator, the trap roller 11 which is rotated on the eccentric shaft 12*a* is caused to contact the blanket 4 in an overlapping manner and withdraw to a position where the trap roller 11 does not contact the blanket 4. The contacting and withdrawing mechanism 12 for enabling the trap roller 11 to contact the blanket 4 and withdraw from it is composed of the eccentric shaft 12*a* which supports the trap roller 11 and the actuator (in the present embodiment, the air cylinder 12*c* functions as the actuator) and, by this simple structure, the trap roller 11 can be brought to a contact position or to a withdrawn position.

As regards this trap roller 11, for providing a both end support structure 21, a fixed shaft 21*a* is mounted on the frame 20 in parallel to the support shaft 11*a* and the tip end portion of the support shaft 11*a* is supported by a support arm 21*b* provided at the tip end portion of the fixed shaft 21*a*. Toe-in of the trap roller 11 can be adjusted by an adjusting screw 21*c* which adjusts length of the support arm 21*b*.

By adjusting the toe-in of the base end portion and the tip end portion of the trap roller, the amount of overlap between the trap roller 11 and the blanket 4 is adjusted to a value of, e.g., about 0.3 mm. In a case where a one-end support structure is adopted, although the amount of overlap varies with rigidity of the trap roller 11 and the support shaft 11*a*, the amount of overall is set to a value between about 0.3 mm and about 0.6 mm having regard to deflection of the end portion, and clearance at the withdrawn position is set at about 0.1 mm.

The outer diameter of the trap roller 11 is set to about the same diameter of the can body 1 so that, by one rotation of the trap roller 11, transfer printing is made from each blanket 4 to the can body 1. By making the outer diameter of the trap roller 11 about the same as the outer diameter of the can body 1 which is an object to be printed and constructing the trap roller 11 with the both end support structure 21, the condition of printing is made nearly the same as that of printing a product with the printer for the can body 1 whereby the ink trap can be carded out in a stable state in which the trap roller 11 is supported on both ends.

In this ink trap apparatus 10, the feed shaft 13 about which the film F is wound in the form of a coil for feeding out is provided on the upstream side of the trap roller 11. The feed shaft 13 is rotatably mounted on a support shaft 13*a* which is fixedly mounted on the frame 20. A core member of the film F is fitted on the feed shaft 13 and fixed to the feed shaft 13 by tightening a nut 13*b*. At the end portion of the feed shaft 13 is fixedly mounted a pulley 13*c* via a friction transmitting mechanism 22 which is made of, e.g., a ball plunger 22*a* so that the pulley 12*c* can be driven for rotation with the toothed belt 19.

By this arrangement, even when the outer diameter of the film F is changed by feeding of the film F and thereby the speed of rotation of the film F is changed, the film F can be fed out with this change in the speed of rotation being absorbed by the ball plunger 22*a*. The friction transmitting force of the ball plunger 22*a* can be adjusted by changing clearance of the ball plunger 22*a*.

In this ink trap apparatus 10, the wind-up shaft 15 on which a wind-up core member 14 is fixedly mounted for winding up the film F in the form of a coil is provided on the downstream side of the trap roller 11. The wind-up shaft 15 is rotatably mounted on a support shaft 15*a* which is fixedly mounted on the frame 20. On both sides of the wind-up core member 14 are provided flange plates 14*a* in the form of a disk and these flange plates 14*a* are fixed to the wind-up shaft 15 by tightening a nut 15*b*.

At the base end portion of the wind-up shaft 15 is fixedly mounted a pulley 15*c* via a friction transmitting mechanism 22 which is made of, e.g., a ball plunger 22*a* so that the pulley 15*c* can be driven for rotation with the toothed belt 19. Even when the outer diameter of the film F is changed by winding up of the film F and thereby the speed of rotation of the film F is changed, the film F can be wound up with this change in the speed of rotation being absorbed by the ball plunger 22*a*.

In the wind-up core member 14 mounted on the wind-up shaft 15, slits for example may be formed on the cylindrical surface of the core member 14 and a spacer may be inserted in each of the slits to maintain a predetermined outer diameter. By removing these spacers, the outer diameter can be reduced.

By this arrangement, when the film F on which the ink has been trapped and has been wound up on the wind-up core member 14 mounted on the wind-up shaft 15 should be disposed, the spacers on the wind-up core member 14 are removed to reduce the outer diameter of the core-member 14 whereby the film F can be taken out of the wind-up core member 14 easily for disposal.

By constructing the wind-up core member 14 for winding up the film F on the wind-up shaft 15 in such a manner that its outer diameter can be reduced, the film F to which the ink is adhered can be separated in a simple manner for disposal.

In this ink trap apparatus 10, the drive roller 16 is provided between the trap roller 11 and the wind-up shaft 15 for accurately pulling out the film F. The drive roller 16 is rotatably mounted on a support shaft 16*a* which is fixedly mounted on the frame 20. A pulley 16*b* is fixedly mounted at the base end portion of the drive roller 16 and the toothed belt 19 is wound on the pulley 16*b* for driving the drive roller 16 for rotation.

As shown in an enlarged scale in FIG. 3A, spikes 16*c* are provided on the drive roller 16 at an equal interval in the circumferential direction for increasing the force to pull out the film F. For example, sixteen spikes 16*c* are provided in the circumferential direction and three rows of spikes are provided in the axial direction in such a manner that the spikes project from the surface of the drive roller 16 by about 2 mm.

In this ink trap apparatus 10, for increasing the winding contact angle of the film F on the trap roller 11 and the drive roller 16 so as to accurately feed the film F for the ink trap, an assisting roller 17 is provided on the upstream side of the trap roller 11 and an assisting roller 18 is provided on the downstream side of the drive roller 16. These rollers 17 and 18 rotatably mounted on a support shaft 17*a* and a support shaft 18*a* respectively.

On the surface of the assisting roller 18 which contacts the ink trap surface of the film F after the ink trap, a fast-drying silicone resin, for example, is coated as an ink adhesion preventing layer 23.

By this arrangement, scattering of the ink accumulated by adhesion of the ink and adhesion of the film F to the assisting roller 18 through the ink can be prevented. It has been confirmed by experiments that the fast-drying silicone resin has sufficient water repellency, durability and wear resistance.

In this ink trap apparatus 10, a drive pulley 24 which is driven for rotation is mounted on a drive shaft 24*a* fixedly mounted on the frame 20. The endless toothed belt 19 is wound on the drive pulley 24, the pulley 11*b* of the trap roller 11, the pulley 13*c* of the feed shaft 13, the pulley 15*c* of the wind-up shaft 15 and the pulley 16*b* of the drive roller 16. The toothed belt 19 is stretched at a constant force by means of a timing belt tightener 25 in such a manner that a constant force is applied to the toothed belt 19 even when the position of the trap roller 11 is changed by the contacting and withdrawing mechanism 12.

The ink trap apparatus 10 can be fixed to a printer frame of the main body of the printer 2 by means of a frame fixing bolt 26 in such a manner that the position of the frame 20 can be adjusted through a slot in which the bolt 26 is inserted.

In this ink trap apparatus 10, an input shaft 27*a* is provided on the opposite side of the trap roller 11 on the frame 20 as a drive mechanism for driving the drive pulley 24. On both ends of this input shaft 27*a*, there are attached an input pulley 27*b* and an output pulley 27*c*. The output pulley 27*c* is connected to an electromagnetic clutch 27*i* which is mounted on the input shaft 27*a* so that the on-off control of power to the ink trap apparatus 10 can be made.

An endless toothed belt 27*e* is stretched between the output pulley 27*c* and a transmission pulley 27*j* provide on the drive shaft 24*a* via two idling pulleys 27*d*. An endless toothed belt 27*h* is stretched between the input pulley 27*b* and a pulley 27*f* of a rotary shaft in a drive gear box of the printer 2 via an idling pulley 27*g*.

By this arrangement, the driving force of the printer 2 is transmitted to the input shaft 27*a* and then to the drive pulley 24 via the input shaft 27*a* to drive the ink trap apparatus 10.

The pulley ratio of the pulley 27*f* of the rotary shaft in the drive gear box of the printer 2 is so set that the pulley 27*f* will rotate six rotations, for example, relative to one rotation of the blanket wheel 3.

To the input shaft 27*a* is attached, as a rotation position detection means 28 for the blanket 4, e.g., a rotation position detection disk 28*a* which is formed with a recess corresponding to the position of the blanket 4. Photo-sensors 28*b* are provided across the rotation position detection disk 28*a* and an on-off signal corresponding to the position of the blanket 4 is thereby output. A detection signal of this rotation position detection disk 28*a* is input to an unillustrated control unit which constitutes a control means which controls the air cylinder of 12*c* of the contacting and withdrawing mechanism 12 in such a manner that the mechanism 12 is brought to the contact position at a selected interval between e.g., 12 blankets 4. When the mechanism 12 should be withdrawn, the control means controls the air cylinder 12*c* of the mechanism 12 in such a manner that, after completion of the ink trap by transferring the ink by causing the mechanism 12 to contact each of the blankets 4 by a predetermined number of times, the mechanism 12 is brought back to the withdrawn position.

As the position detection means, instead of the rotation position detection disc, other detection means may be employed. For example, a rotary encoder may be employed to detect the rotation angle of e.g., the blanket wheel 3 of the printer 2 and thereby detect the position of the blanket 4.

As the film F in the form of a belt used in the ink trap apparatus, a high-density polyethylene film, for example, may be used. For example, a polyethylene film having an ink transfer surface to which a corona discharge treatment has been applied with a thickness of 20 μm may be used. According to the experiment, with respect to all types of printing ink used for a can body of a drink can, no slipping or generation of a wrinkle takes place between the film and the blanket in contacting but smooth and uniform transfer of the ink is performed and, thus, an excellent ink trap effect can be achieved.

As the film F, not only the above described film, but any material such as plastic, paper, cloth or a composite material thereof that can at least remove blurring ink and does not cause slipping or a wrinkle relative to the blanket may be used. A plastic film is particularly suitable. As to thickness of the film, any thickness will be acceptable so long as the film can be fed out from a state of roll.

The operation of the ink trap apparatus 10 having the above described construction and the ink trap method will now be described.

The film F in the form of a coil is mounted on the feed shaft 13 of the ink trap apparatus 10 and the foremost end portion of the film F is attached to the wind-up core 14 of the wind-up shaft 15 in such a manner that the film F is wound on the trap roller 11, the drive roller 16 and the assisting rollers 17 and 18.

After preparation has been completed in the above described manner, operation of the printer 2 is started. The position of the blankets 4 of the blanket wheel 3 to which the ink is transferred is detected by the rotation position detection disk 28*a* of the rotation position detection means 28 and the photo-sensors 28*b* or a rotary encoder. The trap roller 11 is caused to advance to the contact position by the contacting and withdrawing mechanism 12 at a timing of the interval between the blankets 4 while the film F of the ink trap apparatus 10 is fed out by the driving force from the printer 2.

The film F wound on the trap roller 11 is fed while the film F is pressed to each blanket 4 on which the ink has been transferred in an overlapping state whereby surplus ink and blurring ink are transferred to the surface of the film F. The film F to which the ink has been transferred is wound up by the wind-up shaft 15 through the wind-up core 14 and, thus, an always clean film surface contacts the blankets 4.

After repeating of contacting of the trap roller 11 to each blanket 4 by a predetermined number of times, the interval between the blankets 4 is detected by the position detection means 28 and the trap roller 11 is withdrawn for finishing the ink trap.

According to this ink trap apparatus and the ink trap method in which the ink trap is made by transferring the ink to the film F, the number of cans which are thrown away can be reduced significantly as compared to a case where the ink trap is made by using a can body which is an object to be printed. According to a tentative calculation, the cost can be reduced to one sixteenth.

According to the invention, the ink trap can be made by contacting an always clean film to each blanket and, as compared to the prior art case in which the ink transferred to an auxiliary roll is immersed in a solvent and then wiped off, there is no deterioration of cleanliness of the surface of the auxiliary roll with repetition of the ink trap and, therefore, the ink trap can be made in a stable state.

Further, in this ink trap apparatus 10, the driving force necessary for feeding and winding up of the film F is provided by the printer 2 and, therefore, provision of a speed controller and a tension controller is not necessary and, as a result, the structure of the apparatus can be simplified and, moreover, detection of timing of contacting and withdrawing can be made simply by detecting the position of the blanket.

The ink trap is made in the foregoing manner. In printing a can body, finishing varnish is coated after printing. With respect to this finishing varnish, trapping is necessary until the amount of coating of varnish becomes stable.

Figure 7A:
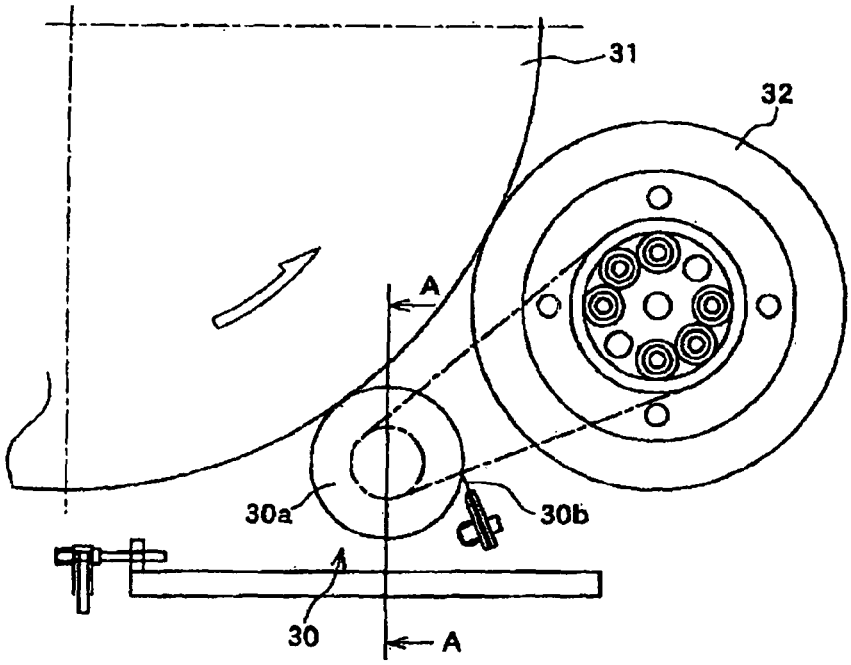
FIGS. 7A and 7B are views for schematically explaining the finishing coating scraping means of the embodiment of the ink trap apparatus which is applied to the printing machine for printing a body of a can.
Figure 7B:
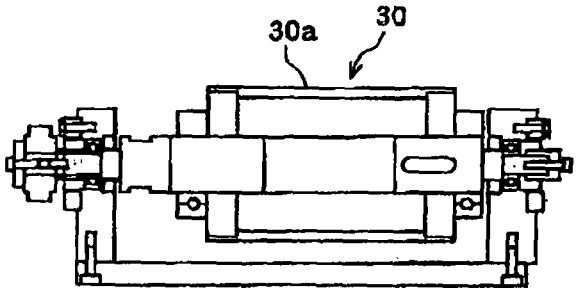

For this purpose, as shown in FIGS. 7A and 7B, in addition to the ink trap apparatus 10, a removing means 30 for trap of a finishing coating is provided. A removing roller 30*a* is caused to contact a lower portion of an applicator roller 31 and the removing roller 30*a* is driven for rotation by driving force of an anilox roller 32. A removing blade 30*b* is provided to contact the removing roller 30. By this arrangement, the amount of varnish as the finishing coating can be controlled.

In the above described embodiment, explanation has been made as to a case where the invention is applied to a printer using a can body as an object to be printed. The invention is not limited to this but it may be applied to a case where printing is made on other objects to be printed such as a curved surface printing and sheet printing.

INDUSTRIAL APPLICABILITY

According to the apparatus and method of this invention, surplus ink or blurring ink can be removed in a simple manner during a period of time from starting or re-staring of the printer till entering a normal printing operation without necessity for operating a printer by using an object to be printed which becomes a product. The method and apparatus are particularly useful for application to a printer of a drink can or the like for preventing production of a printed can which is not suitable as a product.

The invention claimed is:

1. An ink trap apparatus for removing surplus ink or blurring ink before starting a normal printing operation of a blanket of a blanket wheel in a printing machine in which ink is transferred from an ink supply unit to the said blanket of said blanket wheel and transfer printing is made from said blanket of said blanket wheel to an object to be printed, said apparatus comprising a trap roller located opposite said blanket of the said blanket wheel said trap roller being capable of contacting said blanket of said blanket wheel and withdrawing from said blanket of said blanket wheel, and having a film which is fed from a feed shaft about which said film is wound up in the form of a roll and is wound on the trap roller to remove the surplus ink or blurring ink by having said trap roller cause said film to contact said blanket of said blanket wheel said film being sent from said trap roller to a wind-up shaft having a wind-up core on which said film after the ink trap is wound up in the form of a roll, said feed shaft and said wind-up shaft being rotated via a friction transmission mechanism wherein said apparatus further comprises a drive roller for driving said film to be pulled out, said drive roller being provided on a downstream side in a feeding direction of said film from a position where said trap roller contacts said blanket of said blanket wheel through said film, wherein said apparatus further comprises an eccentric shaft and a support shaft which is attached on one end thereof to a frame of said apparatus via said eccentric shaft whereby said support shaft rotatable mounts said trap roller thereon, wherein said apparatus further comprises a toothed belt, a timing belt tightener, a drive pulley, a pulley of said wind-up shaft, a pulley of said feed shaft, a pulley of said trap roller, and a pulley of said drive roller; a driving force of said printing machine is transmitted to said drive pulley to drive said apparatus, and said drive pulley drives said pulley of said wind-up shaft, said pulley of said feed shaft, said pulley of said trap roller, and said pulley of said drive roller via a toothed belt that is wound on each of said drive pulley, said pulley of said wind up shaft, said pulley of said feed shaft, said pulley of said trap roller and said pulley of said drive pulley such that said toothed belt is stretched at a constant force by means of said timing belt tightener in such a manner that a constant force is applied to said toothed belt even when a position of said trap roller is changed to cause said film to contact said blanket of said blanket wheel film or to change said trap roller and cause said film to not be in contact with said blanket of said blanket wheel.

2. An ink trap apparatus as defined in claim 1 wherein the film which has removed the surplus ink or blurring ink is wound up and has an ink transfer surface to which a corona discharge treatment has been applied.

3. An ink trap apparatus as defined in claim 1 wherein the drive roller has spikes on the surface of the roller for applying increasing force to said film in order to pull out said film.

4. An ink trap apparatus as defined in claim 1 further comprising position detection means for detecting each interval between a plurality of the blankets which are provided on the blanket wheel, said trap roller contacting the blanket and withdrawing from the blanket in response to a position detection signal from a position detection means.

5. An ink trap apparatus as defined in claim 1 further comprising assisting rollers provided adjacent to the trap roller and/or the drive roller for increasing a winding contact angle of the film wherein at least an assisting roller which contacts an ink transferred surface of the film after the ink trap is provided on the surface of the assisting roller with an ink adhesion preventing layer for preventing adhesion of the ink.

* * * * *